US005819471A

United States Patent [19]

Koerber

[11] Patent Number: 5,819,471

[45] Date of Patent: Oct. 13, 1998

[54] RETRACTABLE POST

[76] Inventor: Gary Koerber, 9921 Big Meadow Rd., Jefferson City, Mo. 65101

[21] Appl. No.: 920,035

[22] Filed: Aug. 28, 1997

[51] Int. Cl.[6] ..... E01F 13/00

[52] U.S. Cl. ..... 49/49; 49/35; 49/506; 404/6

[58] Field of Search ..... 49/49, 35, 131, 49/506; 404/6, 11

[56] References Cited

U.S. PATENT DOCUMENTS

| | | | |
|---|---|---|---|
| 4,003,161 | 1/1977 | Collins | 49/49 X |
| 4,576,508 | 3/1986 | Dickinson | 404/6 |
| 4,666,331 | 5/1987 | Riley | 404/6 |
| 4,715,742 | 12/1987 | Dickinson | 404/6 |
| 4,919,563 | 4/1990 | Stice | 404/6 |
| 5,054,237 | 10/1991 | Kapala et al. | 49/35 |
| 5,070,646 | 12/1991 | Colombo | 49/49 |
| 5,192,159 | 3/1993 | Higginson | 404/11 |
| 5,365,694 | 11/1994 | Macaluso | 49/49 |
| 5,425,595 | 6/1995 | Roper | 49/49 X |
| 5,462,384 | 10/1995 | Arlandis | 49/49 X |
| 5,476,338 | 12/1995 | Alberts | 404/6 |
| 5,481,828 | 1/1996 | Kentrotas | 49/35 |

*Primary Examiner*—Jerry Redman
*Attorney, Agent, or Firm*—Richard J. Grundstrom

[57] ABSTRACT

A retractable post that can be raised and lowered and stored in retracted subsurface position such that the post will be out of the way. The post can be extended to an upright position and locked in that position by a specific lift, twist and set locking mechanism. The post is lowered by a specific lift, twist and lower sequence in a somewhat reverse order. The post is typically used with a sign such as no parking, handicap parking, area closed or other such uses. The retractable post is designed so the post can be lowered for area maintenance such as snow removal or for general closing and opening access to restricted area. In a simple configuration of the retractable post, the retractable post contains a housing, a sleeve stabilizer attached to a top of the housing, a post having an elongated flat surface, a locking notch, a turning groove and a stabilizing end, and a D-block. The D-block has a D shaped opening that interacts with the turning groove on the post to allow the post to rotate. The locking notch allows the post to be lowered in a locking position. The longitudinal flat surface when aligned with the D-shaped opening allows the post to be lower or raised. Indicia may be contained on the longitudinal flat surface to rely information or instruction to an individual.

19 Claims, 6 Drawing Sheets

RETRACTABLE POST

BACKGROUND OF THE INVENTION

The present invention relates to a retractable post and more particularly to a post that can be lowered and raised with a specific lift, twist and lock sequence.

There are all sorts of traffic barriers known in the art. Traffic barriers are used in both vehicular and pedestrian traffic. Most of the barriers of the past were either fixed in a given position or are portable. The portable barriers had to be physically moved from location to location for each use. This requires time and energy in transporting the barrier and setting them up for each use. The barriers could also be heavy or hard to handle. This made it very cumbersome to setup and move.

There are also fixed barriers that are more or less permanent in nature. There are many different types of permanent barriers such as signs, posts, and other barriers. If the traffic pattern had to be changed it was expensive to change. The permanent barriers or signs also get in the way for maintenance. Permanent barriers or traffic control devices make it difficult to remove or to make changes as traffic patterns change.

There are also posts that could be lowered into various types of housing. These posts could also be raised as needed. Several of these are for emergency use and are actually physical structures that act as barriers to stop a vehicle. These have been hydraulic operated, raised suddenly with explosives or springs under extreme bias. These types of retractable posts or security post are in general not very convenient to use or are not designed for repeated use. Yet others are used for securing a parking space with or without a vehicle. This typically require some external locking system for securing the post in a raised position. Most are also very cumbersome to use.

The present invention provides a means of overcoming the obstacles of the prior known art of fixed and permanent signs, traffic control devices and barriers.

Accordingly, it is an object of the present invention to provide a retractable post that can be easily raised and lowered to provide a means of easily controlling either pedestrian or vehicular traffic.

Another object of the present invention is to provide an improved retractable post constructed in such a way as to provide a system to lock the post in an upright position that is not obvious too individuals not familiar with the system. This provides a method of security to keep the post in the desired position without external devices. The prior art generally required an external lock or other external mechanism to interact with the post. The present invention incorporates a unique lift, twist and set locking sequence to secure a retractable post in an upright position.

A further object of the present invention is to provide a retractable post that can contain indicia or signs to provide instruction or information to an individual.

Still another object of the present invention is to provide a retractable post that uses a specific lift, twist and lowing technic to lock the post in an upright position and a reversal of operation to lower the post. This substantially reduces the cost, time and energy needed to raise and secure a retractable post in an upright position and provides a simple means of lowering the post to a lower and out of the way position. With the retractable post of this invention it has been found that the time needed to lower raise and lower the post has been reduced because no additional equipment needed. The post can be easily raised and lowered by a single person without any tools or any other supplies.

It is also another objective of this invention to provide a retractable post that is relatively inexpensive, with parts that are easily replaced or removed for repair or maintenance.

SUMMARY OF THE INVENTION

To accomplish the foregoing and other objects of this invention there is provided a retractable post and more particularly a post that can be retracted to a subsurface position and extended to an upright position for use.

The retractable post of this invention includes a post that can be stored in retracted subsurface position within a housing such that the post will be out of the way. The post can be extended to an upright position and locked in that position by a specific lift, twist and set locking mechanism. To lower the post the specific lift, twist and lowering sequence must be followed in a somewhat reverse order. The post is typically used with a sign, such as no parking, handicap parking, area closed or other such uses. The retractable post of this invention is designed so the post can be lowered for area maintenance, such as snow removal or for closing-opening access to restricted areas as desired.

In a most simple embodiment, the retractable post contains a housing, a sleeve stabilizer, a D-block and a post. The sleeve stabilizer is mounted on top of the housing. A center opening in the sleeve stabilizer provides the means of the post to enter the housing. The D-block is attached to the top of the sleeve stabilizer. The D-block has a D-opening that interacts with the elements on the post to provide the lift, twist and set locking sequence. The post contains a turning groove, locking notch and a longitudinal flat surface all of which interacts with the D-block to provide the specific locking sequence.

The foregoing and other objects and features of the present invention will be better understood and appreciated from the following detailed description of the main embodiment thereof, selected for purposes of illustration and shown in the accompanying drawings.

DETAILED DESCRIPTION

Figure 1:
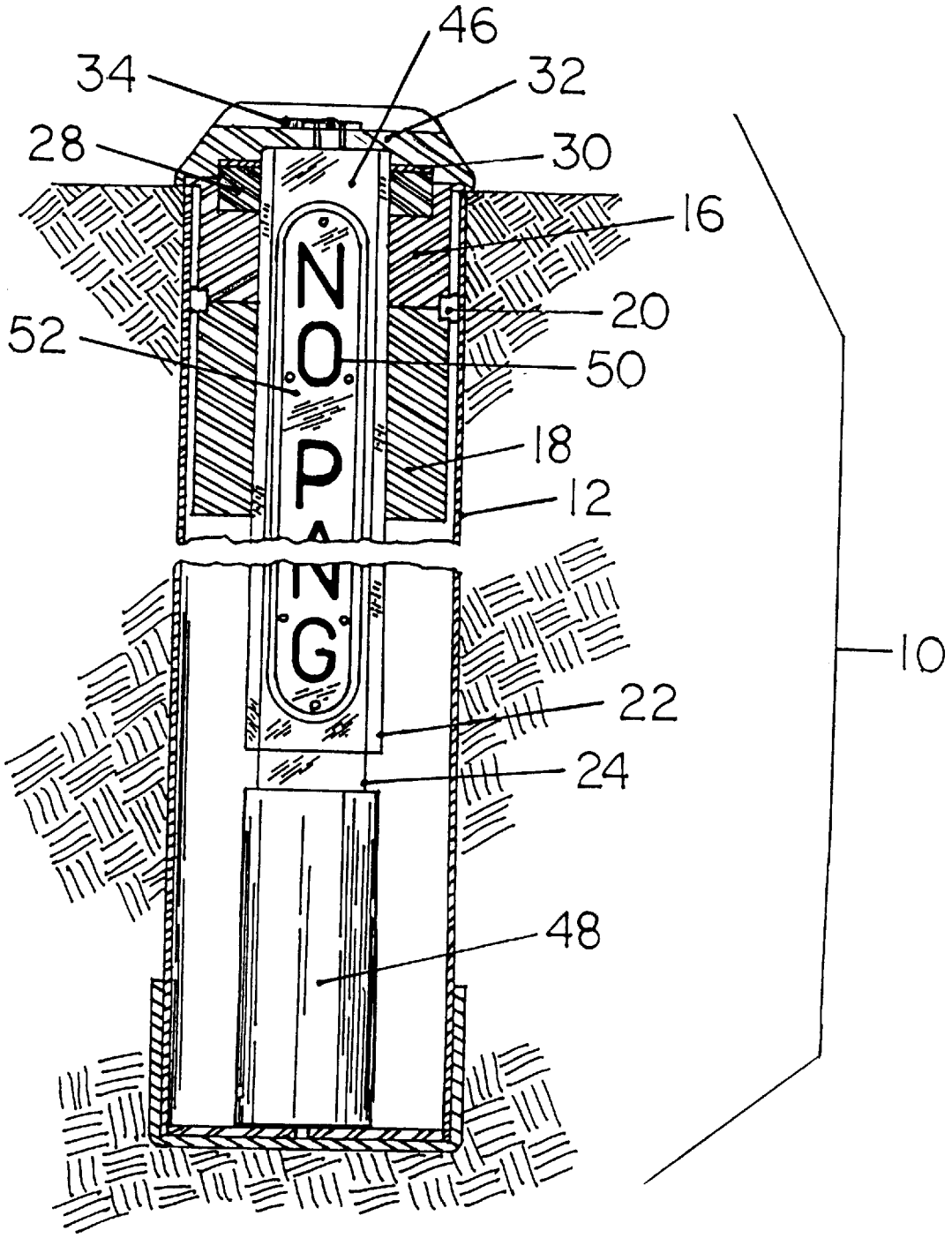
FIG. 1 is a side elevation showing the retractable post in a retracted position and submerged under a surface.
Figure 2:
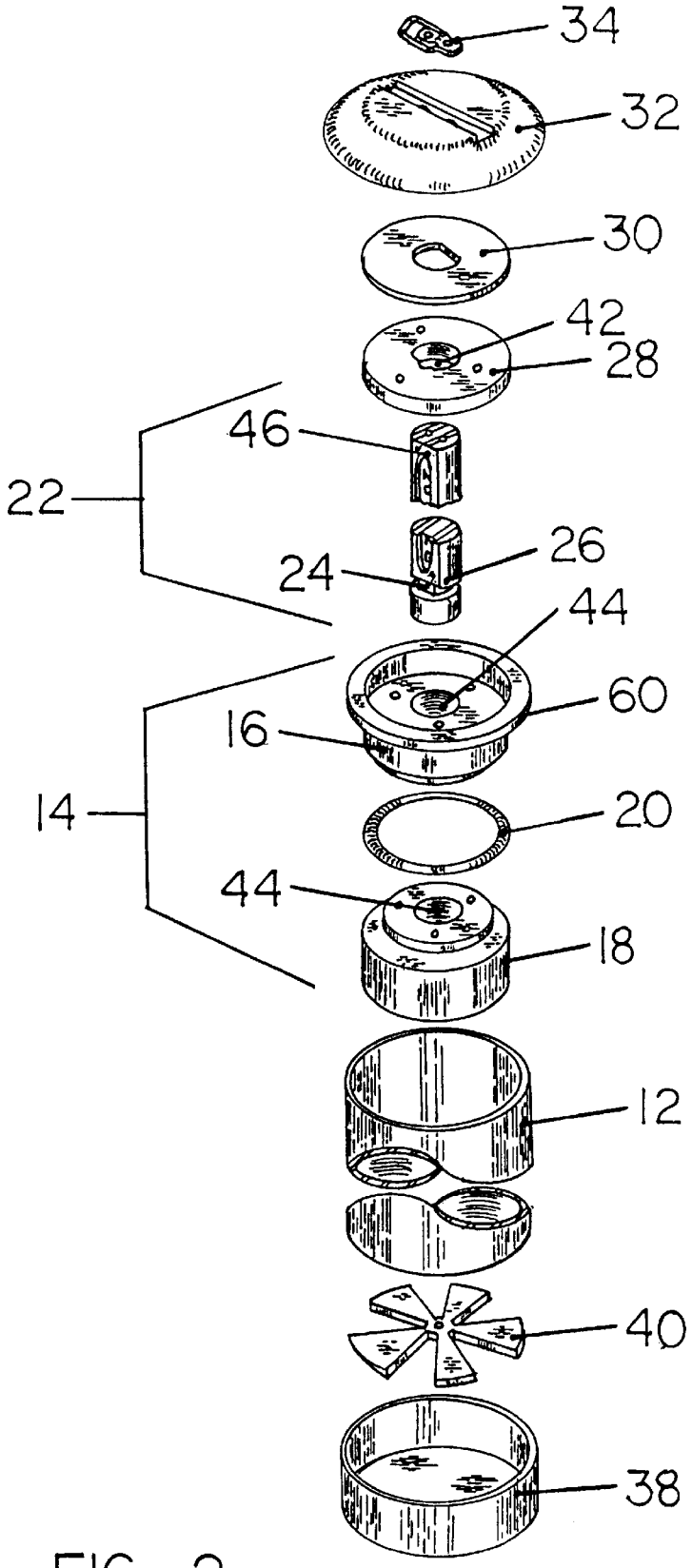
FIG. 2 is an exploded view showing the relationship of the components of the retractable post.

Referring to the drawings there is shown one preferred embodiment of the retractable post of this invention. The specific embodiment shown is typical of the implementation of this invention. However, the specific embodiment described herein is for illustrating the principle features of this invention. The scope and limits are not to be determined by the description of the preferred embodiment but rather by the larger and broader implementation of the concepts as claimed.

In general, the post 10 can be stored in retracted subsurface position such that the post 22 will be out of the way, as shown in FIG. 1. The post 22 can be extended to an upright position and locked in that position by a specific lift, twist and set locking sequence using the particular mechanism as described below. To lower the post 10 a specific lift, twist and lowering sequence must be followed. The post 22 is typically used with a sign 52 incorporating indicia 50 such as no parking, handicap parking, area closed or other such uses. However, the indicia 50 can be printed or painted directly on the post 22. The retractable post 10 of this invention is designed so the post 22 can be lowered for controlling access to restricted area, indicating there is no parking or to open and close an area. The retractable post 10 of this invention could be used indoor as well as out. A typical indoor use would be to close aisles within stores or hallways in commercial buildings. A typical outdoor use would be for controlling access or traffic flow and for sign removal for area maintenance such as for snow plowing and other maintenance.

The retractable post 10 in the most basic embodiment generally consists of a housing 12, a sleeve stabilizer 14 fitting within or on top of the housing 12, a D-block 28 attached to the top of the sleeve stabilizer 14 and the post 22. A longitudinal flat surface 46, a turning groove 24 and a locking notch 26 all located on the post 22 work in conjunction with a D-shaped opening 42 on the D-shaped block to provide the specific lift twist and lock motion of this invention.

The preferred embodiment and the best mode contemplated of the retractable post of the present invention are herein described. However, it should be understood that the best mode for carrying out the invention hereinafter described is offered by way of illustration and not by the way of limitation. It is intended that the scope of the invention include all modifications that incorporate its principal design features.

The housing 12 provides the exterior and support structure of the retractable post 10 of this invention. The shape could be round, square, rectangular or any other shape and is generally an elongated tube of the forementioned shapes. In the preferred embodiment, the housing 12 is cylindrical tube. The material used could be any durable and generally weather resistant material. The diameter or dimensions are determined by the specific function or purpose of the retractable post 10. Outdoor or road use or use with signs would typically require larger dimensions than for indoor use, such as in a hall or for any other indoor use. The specific dimensions are determined by the application.

The best mode contemplated and the preferred embodiment as illustrated is for use with a sign 52. The housing 12, in this preferred embodiment, is made from a six inch PVC pipe four feet long.

The housing 12, would of course, have a top end and a bottom end. The housing 12 is typically buried under a surface, such as the ground or floor, with the top end being flush with the surface. The bottom end will typically be closed using some sort of bottom cap 38.

The sleeve stabilizer 14 is attached to and closes the top of the housing 12. The outer shape of the sleeve stabilizer 14 would out of necessity correspond to the shape of the housing 12. The sleeve stabilizer 14 has an opening 44 therethrough for receiving the post 22. The shape of the opening 44 is typically round but other shapes could also function without departing from the scope and spirit of this invention.

In the preferred embodiment, the sleeve stabilizer 14 consists of three separate component. However, other configurations as well as a one piece sleeve stabilizer 14 would also function. The scope of the invention is to be determined by the claims and not the specific preferred embodiment disclosed and illustrated. The three piece system used in the sleeve stabilizer 14 is the best mode contemplated at the time of the invention.

The three pieces, of the preferred embodiment, consist of a sleeve 16, O-ring 20 and a stabilizer 18. These pieces fit together to form an integrated unit for supporting the post 22 in an upright position and support for the D-block that functions to provide the specific lift, twist and lock sequence of this invention. The sleeve 16, in the preferred embodiment, has an upper lip 60 that contacts the top edge of the housing 12. The lip 60 prevents the sleeve stabilizer 14 from dropping into the housing 12. The stabilizer 18 attaches to the bottom of the sleeve 16. In other words, the bottom surface of the sleeve 16 is attached to the top surface of the stabilizer 18. The O-ring 20 is positioned between the sleeve 16 and the stabilizer 18. An O-Ring groove may be provided to properly position the O-ring 20 at the junction of the sleeve 16 and stabilizer 18. As the sleeve 16 and stabilizer 18 are tightened together, the O-ring 20 is squeezed such that the outer perimeter contacts the inside surface of the housing 12. This provides friction fit to secure the sleeve stabilizer 14 within the housing 12.

The post 22 enters though and is slidable within the opening 44 through the sleeve stabilizer 14. The post 22 must have a combination of elements in order to function. The elements in the preferred embodiment generally consist of a longitudinal flat surface 46, a turning groove 24, locking notch 26 and a stabilizing end 48. These elements work in conjunction with the sleeve stabilizer 14 and the D-block to provide the lift twist and lock action of this invention and for stabilizing the post 22 when in an upright extended position.

The longitudinal flat surface 46 extends longitudinally between the top end of the post 22 and the turning groove 24. The locking notch 26 is located on the opposite side of the post 22 from the longitudinal flat surface 46 just above the turning groove 24. The stabilizing end 48 is the bottom portion of the post 22 and it fits snugly within the opening 44 of the sleeve stabilizer to provide stability to the post 22 when in an extended upright position. The interaction of these elements will be described in detail below.

A friction device 40 can be attached to the bottom end of the post 22. The outer ends of the friction device 40 contacts the inside surface of the housing too slow and control the decent of the post within the housing. The friction device 40 also functions as guide to keep the bottom of the post 22 centered within the housing 12 and as a secondary stop to prevent the post 22 from being pulled out of the housing 12 through the opening 44 in the sleeve stabilizer 14.

The post 22, as an option, can also contain some sort of indicia 50 to relay a message to an observer. The typical message is inform individuals of some fact. This could be "No Parking" as illustrated, or any other message such as area closed, handicap parking, no not enter, close until 6:00 P.M. or any other such messages. In another embodiment, not shown, a series of retractable post 10 are used to block the way, with or without any messages.

The indicia 50 is typically displayed on the longitudinal flat surface 46 on post 22 and is visible when the post 22 is in an upright extracted position. Provisions can also be made for a sign 52 containing the indicia 50. The sign is then attached to the longitudinal flat surface 46. A notched out area 54 may be provided for the sign 52. The notched out area 54 prevents the sign 52 from interfering with the decent or lifting the post 22 through the D-shaped opening 42 in the D-block 28.

Figure 3:
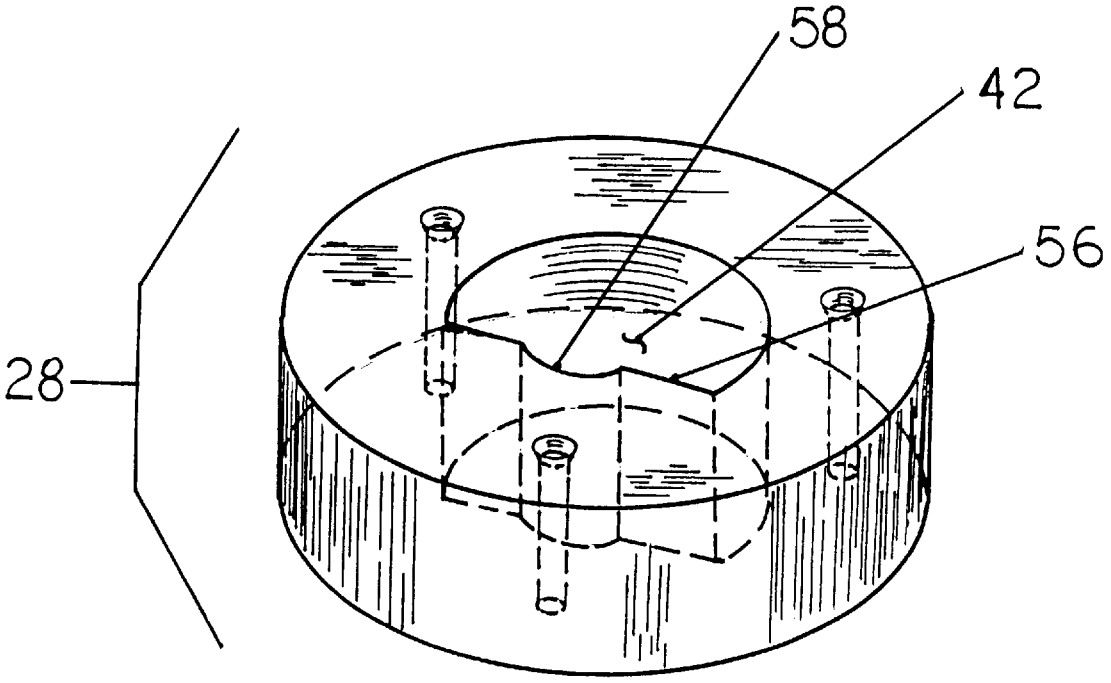
FIG. 3 is an isometric view of the D-block.
Figure 4:
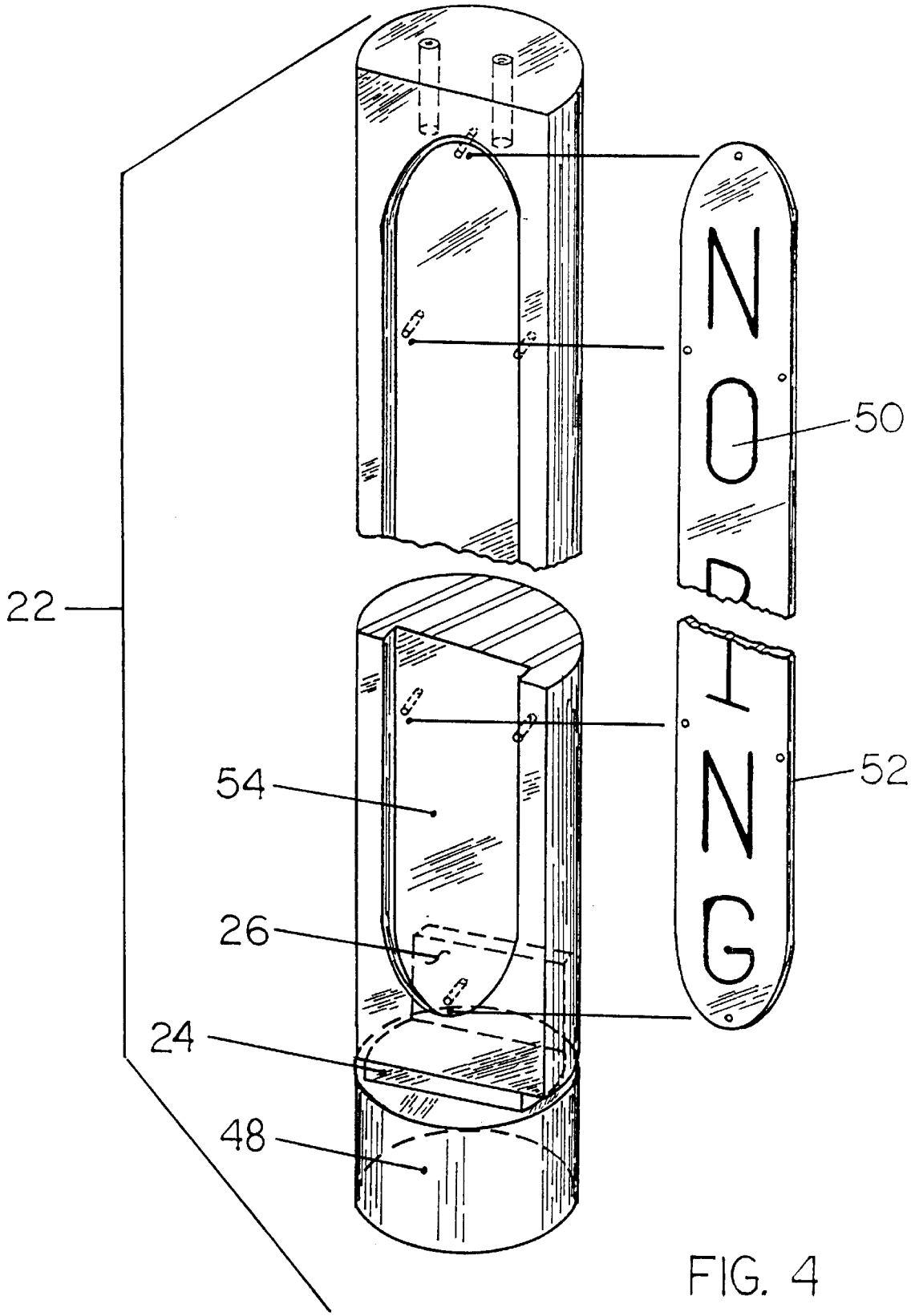
FIG. 4 is an isometric view of the post and a sign having indicia.

The D-block 28 fits on top of and is attached to the top of the sleeve stabilizer 14. The D-block 28 has a D-shaped opening 42, with a flat portion 46, which would be positioned above the opening 44 in the sleeve stabilizer 14. The flat portion 46 may also have an indentation 58, FIG. 3, for provide clearance of the rotating post 22. The indentation allows more material within the center of the turning groove 24, hence providing additional strength to the post 22.

The D-shaped opening 44 allows the post 22 to be raised and lowered with the post 22 in one specific position, that is with the longitudinal flat surface 46 on post 22 in alignment with the flat portion 56 of the D-shaped opening 42. The post 22 will only rotate when the turning groove 24 is in alignment with the D-block 28.

Figure 5A:
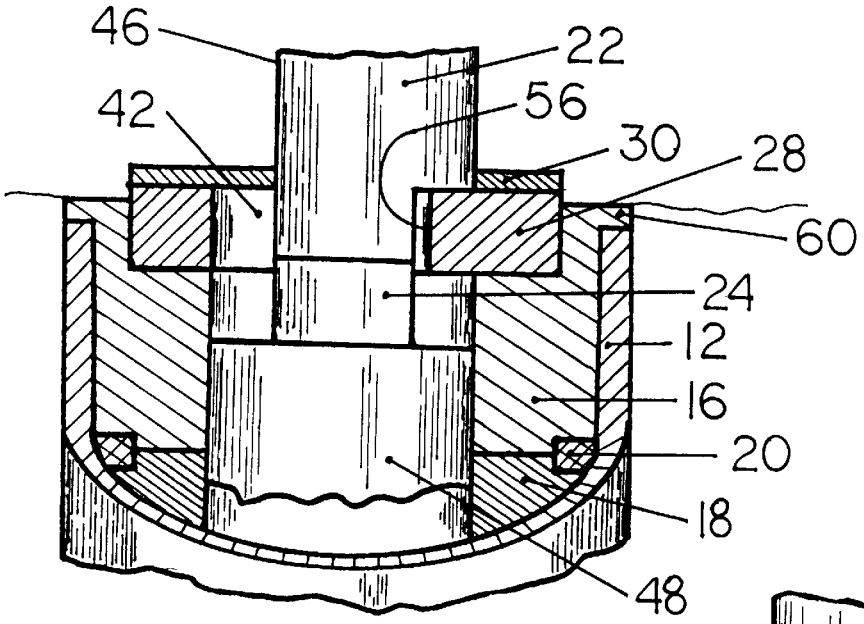
FIG. 5A–5D are a series of side views showing the locking action of the post with the D-block and the sleeve stabilizer.

Referring to FIG. 5A, the post 22 is locked in an upright position by the locking notch 26 being positioned within the flat portion 56 of the D-shaped opening 42. The post 22 is lowered within the D-opening 42 such that the top inside surface of the locking notch 26 engages the top surface of the D-block 28. In this position the turning groove 24 is below the D-block and the post 22 cannot be rotated. The turning groove 24 on post 22 must be positioned within the D-shaped opening 42 to allow the post 22 to rotate.

Figure 5B:
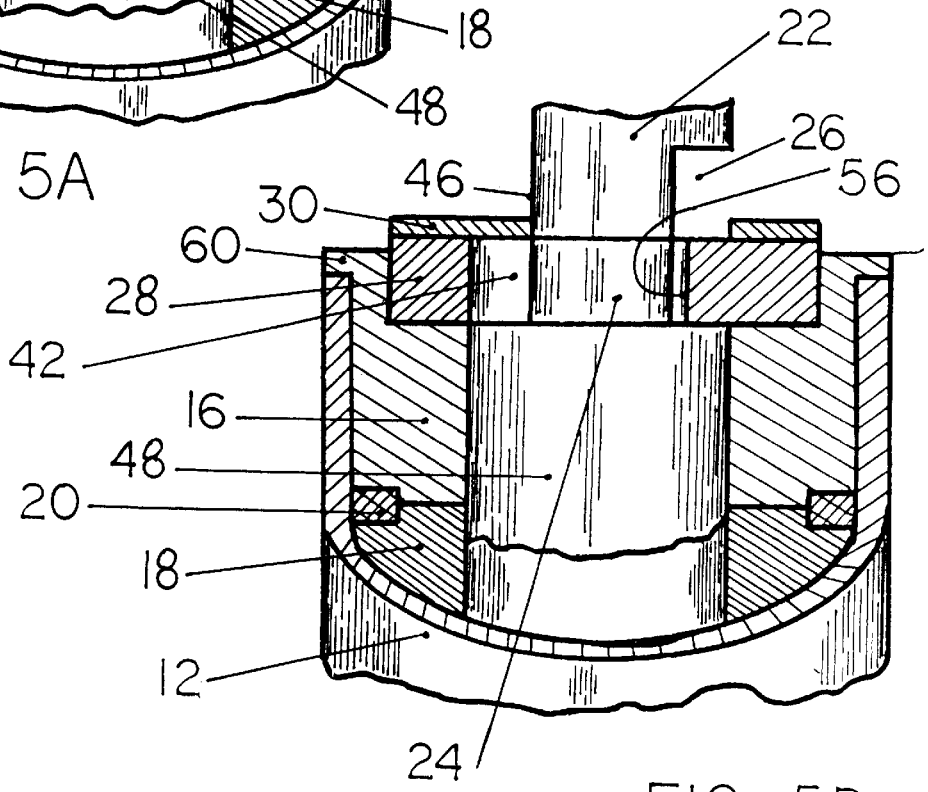

FIG. 5B shows the first step in lowering the post 22 to a retracted position. The post 22 is raised to align the turning groove 24 with the D-block 28. In this position the locking notch 26 clears the top surface of the D-block 28. This allows the post 22 to rotate. Note also that the top of the stabilizing end 48 butts against the bottom surface of the D-block 26 when the post 22 is raised. This provides a stop to prevent the post 22 from being extracted from the opening 44 in the sleeve stabilizer 14 and indication of proper position of the turning groove 24 for post 22 rotation.

Figure 5C:
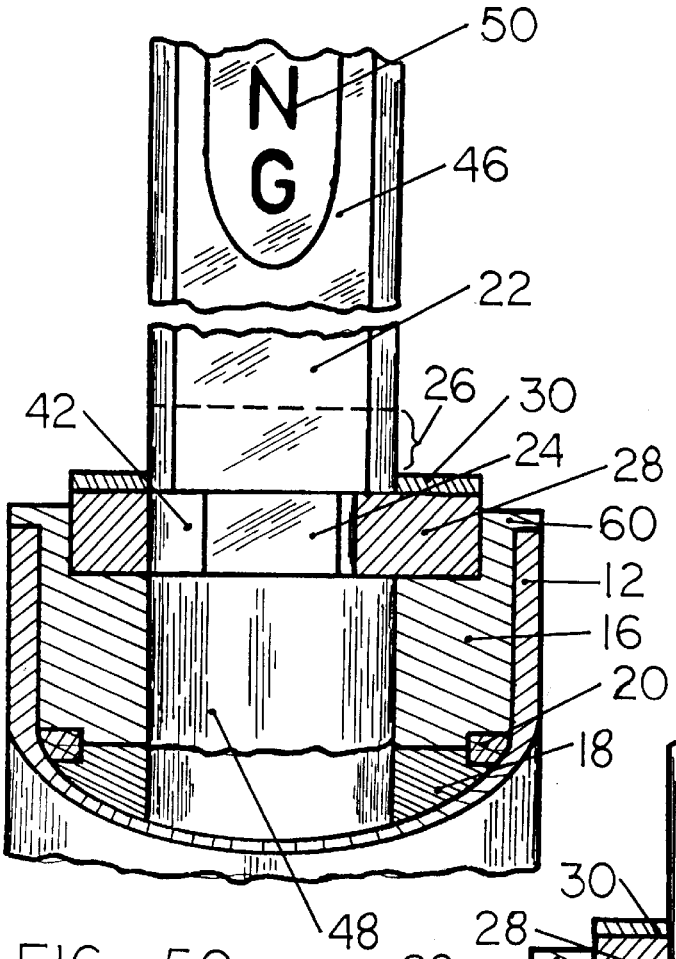

FIG. 5C shows the post 22 being rotated. The turning groove 24 is in alignment with the D-block 28 and the top of the locking notch 26 is above the top surface of the D-block 28, as shown by the phantom line. The post 22 cannot be raised or lowered in this position. The post 22 can only rotate because there is no flat surface, either the flat surface of the locking notch 26 or the longitudinal flat surface 46 on post 22, in alignment with the flat portion 56 on the D-shaped opening 42.

Figure 5D:
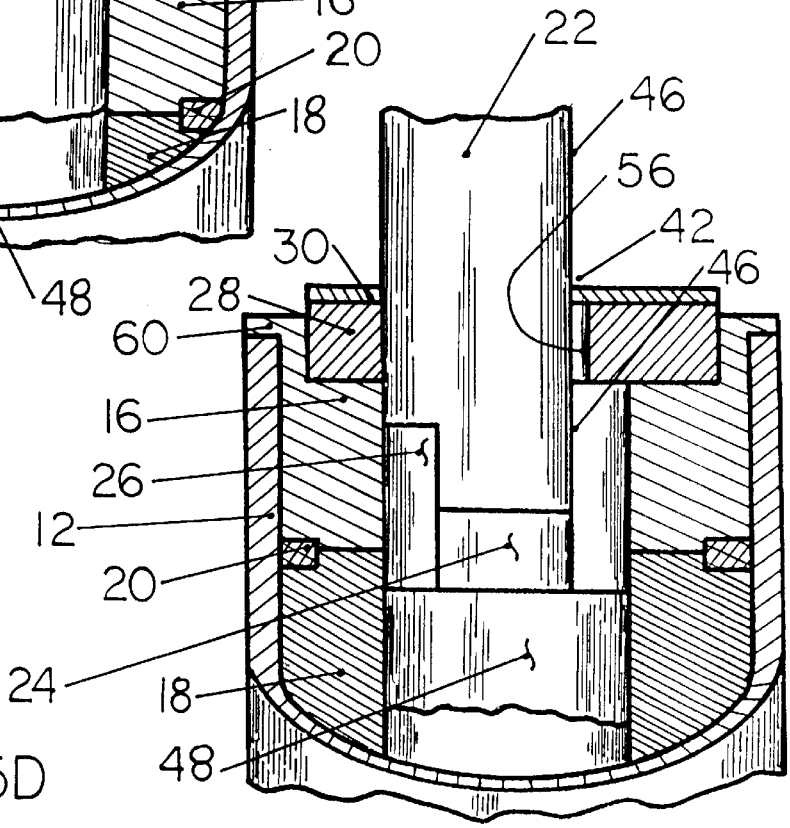

FIG. 5D shows the post 22 being lowered into the housing 12. The longitudinal flat surface 46 on post 22 is aligned with the flat portion 56 of D-opening 42. In this position, the post 22 can only be raised or lowered. It cannot be rotated because the turning groove 24 is out of alignment with the D-block 28.

A D-washer 30 is provided as a means of keeping water and other elements from entering the housing through the D-opening 42 in the D-block 28. The D-washer 30 only rests upon the top surface of the D-block 28. The D-washer 30 also has a D-shaped opening that fits over post 22 in alignment with the longitudinal flat surface 46. Gravity holds it in place and it rotates with the post 22. It also functions to obscure or block the view of the screws used to hold the D-block to the sleeve stabilizer 14.

A D-cap 32 is provided to cover and seal the housing 12 when post 22 is in a retracted position. The D-cap 32 is attached to the top end of post 22 and has a D-shaped insert for receiving the upper end of the post 22. A handle or ring 34 may be attached to the top of the D-cap. The handle 34 would be used to raise and lower the post 22.

Throughout the above description various elements are attached to one another. The typical attachment means, in the preferred embodiment, is by appropriate size screws, either plastic or metal. Other attachment means such as plastic cement, bolts, retaining clips or any other attachment means could be used either singularly or in any combination, without departing from the scope and spirit of the inventive concepts herein disclosed.

In the preferred embodiment, all the various components or elements are made from PVC, or other equivalent plastics or composite material. The purpose of the plastic is for the durability against the weather and for weight and strength consideration. The various components could be made from any type material, either in totality or in combination. The specific material used is not detrimental to the scope of this invention. The specific scope is for the actual components and configuration related thereto.

Assembly and disassembly of the retractable post 10 is fairly simple. The assembly of the retractable post is the opposite procedure of the disassembly. For ease of description disassembly is herein described. First, the post 22 is placed in an upright extended position. The D-block is then loosened such that it can be raised from the sleeve stabilizer 14. This provides access to the top of the sleeve stabilizer 14. The screws used to attach the stabilizer to the sleeve are loosened to relieve the pressure on the O-ring 20. This lessens the friction on the inside of the housing 12. The whole assembly of post 22, D-block 26, sleeve stabilizer 14 can then be lifted out of the housing 12. Assembly is in the reverse order.

Having described the invention in detail, those skilled in the art will appreciate that modifications may be made of the invention without departing from the spirit of the inventive concept herein described.

Therefore, it is not intended that the scope of the invention be limited to the specific and preferred embodiments illustrated and described. Rather, it is intended that the scope of the invention be determined by the appended claims and their equivalents.

What is claimed is:

1. A retractable post comprising:

an elongated housing having a top end and a bottom end;

a sleeve stabilizer attached to said top end of said housing, said sleeve stabilizer having a circular opening therethrough;

a post slidable within said opening in said sleeve stabilizer, said post having a longitudinal flat surface, a turning groove, locking notch and a stabilizing bottom end, said longitudinal flat surface extending between a top end of said post and said turning groove, said locking notch being above said turning groove opposite said longitudinal flat surface, and said stabilizing end on a lower end of said post, said stabilizing end fitting snugly within said opening in said sleeve stabilizer to provide stability to said post when in an upright position; and a D-block, said D-block attached to a top surface of said sleeve stabilizer and having a D-shaped opening positioned above said opening in said sleeve stabilizer, said turning groove on said post aligned with said D-shaped opening to allow said post to rotate, said locking notch locking said post in an upright position when said post is lowered into said D-block; said post being retracted by first lifting said post such that said locking notch clears a top surface of said D-block and said turning groove aligned within said D-shaped opening, said post is rotated such that said longitudinal flat surface is aligned with said D-shaped opening, once said longitudinal flat surface is aligned with said D-shaped opening said post can be lowered into said housing.

2. The retractable post as set forth in claim 1 in which said housing is a cylindrical tube.

3. The retractable post as set forth in claim 1 in which said housing is buried under a surface with said top end being flush with said surface.

4. The retractable post as set forth in claim 1 in which said sleeve stabilizer comprises a sleeve, O-ring and a stabilizer, a bottom end of said sleeve attached to a top end of said stabilizer, said O-ring being squeezed between said sleeve and said stabilizer as said sleeve and said stabilizer are attached, said O-ring contacting an inside surface of said housing for securing said sleeve stabilizer within said housing.

5. The retractable post as set forth in claim 1 further claiming a D-washer, said D-washer resting upon a top surface of said D-block, said D-washer having a D-shaped opening through which said post extends through, said D-washer providing a means of keeping water and other elements from entering said housing through said opening in said D-block.

6. The retractable post as set forth in claim 1 further claiming a D-cap, said D-cap attached to said top end of said post said D-cap covering said top end of said housing.

7. The retractable post as set forth in claim 6 further claiming a handle, said handle attached to the top of said D-cap, said handle being used to raise and lower said post.

8. The retractable post as set forth in claim 1 further claiming a friction device, said friction device being attached to a bottom end of said post, outer ends of said friction device contacting an inside surface of said housing to control the decent of said post within said housing.

9. The retractable post as set forth in claim 1 further claiming indicia, said indicia displayed on said longitudinal flat surface on said post, said indicia being displayed when said post is in an upright position.

10. The retractable post as set forth in claim 9 in which said indicia sign.

11. The retractable post as set forth in claim 1 further claiming a bottom cap, said bottom cap closing said bottom end of said housing.

12. The retractable post as set forth in claim 1 further claiming a bottom cap, said bottom cap closing said bottom end of said housing.

13. A retractable post comprising:

an elongated housing, said housing being a cylindrical tube having a top end and a bottom end;

a sleeve stabilizer attached to said top end of said housing, said sleeve stabilizer having a circular opening therethrough, said sleeve stabilizer comprising a sleeve, O-ring and a stabilizer, a bottom end of said sleeve attached to a top end of said stabilizer, said O-ring being squeezed between said sleeve and said stabilizer as said sleeve and said stabilizer are attached, said O-ring contacting an inside surface of said housing for securing said sleeve stabilizer within said housing;

a post slidable within said opening in said sleeve stabilizer, said post having a longitudinal flat surface, a turning groove, locking notch and a stabilizing bottom end, said longitudinal flat surface extending between a top end of said post and said turning groove, said locking notch being above said turning groove opposite said longitudinal flat surface, and said stabilizing end fitting snugly within and being stabilized within said opening in said sleeve stabilizer;

a D-block, said D-block attached to a top surface of said sleeve stabilizer and having a D-shaped opening positioned above said opening in said sleeve stabilizer, said turning groove on said post when aligned with said D-shaped opening allows said post to rotate within said D-shaped opening, said locking notch locking said post in an upright position when said locking notch is aligned within said D-opening and said post is lowered into said D-block; said post being retracted by first lifting said post such that said locking notch clears a top surface of said D-block and said post is rotated such that said longitudinal flat surface is aligned with said D-shaped opening, once said longitudinal flat surface is aligned with said D-shaped opening said post can be lowered into said housing;

a D-washer, said D-washer resting upon a top surface of said D-block, said D-washer having a D-shaped opening through which said post extends through, said D-washer providing a means of keeping water and other elements from entering said housing through said opening in said D-block; and a D-cap, said D-cap attached to said top end of said post, said D-cap covering said top end of said housing.

14. The retractable post as set forth in claim 13 in which said housing is buried under a surface with said top end being flush with said surface.

15. The retractable post as set forth in claim 13 further claiming a handle, said handle attached to the top of said D-cap, said handle being used to raise and lower said post.

16. The retractable post as set forth in claim 13 further claiming a friction device, said friction device being attached to a bottom end of said post, outer ends of said friction device contacting an inside surface of said housing to control the decent of said post within said housing.

17. The retractable post as set forth in claim 13 further claiming indicia, said indicia displayed on said longitudinal flat surface on said post, said indicia being visible when said post is in an extracted position.

18. A retractable post comprising:

a housing, said housing being a cylindrical tube having a top end and a bottom end, said housing being buried under a surface with said top end being flush with said surface;

a bottom cap, said bottom cap closing said bottom end of said housing;

a sleeve stabilizer attached to said top end of said housing, said sleeve stabilizer having a circular opening therethrough, said sleeve stabilizer comprising a sleeve, O-ring and a stabilizer, a bottom end of said sleeve attached to a top end of said stabilizer, said O-ring being squeezed between said sleeve and said stabilizer as said sleeve and said stabilizer are attached, said O-ring contacting an inside surface of said housing for securing said sleeve stabilizer within said housing;

a post slidable within said opening in said sleeve stabilizer, said post having a longitudinal flat surface, a turning groove, locking notch and a stabilizing bottom end, said longitudinal flat surface extending between a top end of said post and said turning groove, said locking notch being above said turning groove opposite said longitudinal flat surface, and said stabilizing end fitting snugly within and being stabilized within said opening in said sleeve stabilizer;

a friction device, said friction device being attached to a bottom end of said post, outer ends of said friction device contacting an inside surface of said housing to control the decent of said post within said housing;

indicia, said indicia displayed on said longitudinal flat surface on said post, said indicia being visible when said post is in an extracted position;

a D-block, said D-block attached to a top surface of said sleeve stabilizer and having a D-shaped opening positioned above said opening in said sleeve stabilizer, said turning groove on said post when aligned with said D-shaped opening allows said post to rotate within said D-shaped opening, said locking notch locking said post in an upright position when said locking notch is aligned within said D-opening and said post is lowered into said D-block; said post being retracted by first lifting said post such that said locking notch clears a top surface of said D-block and said post is rotated such that said longitudinal flat surface is aligned with said D-shaped opening, once said flat longitudinal flat surface is aligned with said D-shaped opening said post can be lowered into said housing;

a D-washer, said D-washer resting upon a top surface of said D-block, said D-washer having a D-shaped opening through which said post extends through, said D-washer providing a means of keeping water and other elements from entering said housing through said opening in said D-block;

a D-cap, said D-cap attached to said top end of said post, said D-cap covering said top end of said housing; and a handle, said handle attached to the top of said D-cap, said handle being used to raise and lower said post.

19. A method of raising and lowering a retractable post and locking the post in an upright position having steps comprising:

raising a post from a lower stored position, from within a housing, to an upward position until a turning groove on said post is aligned with a D-block on a top of said housing:

rotating said post until a flat portion of a locking notch in said post is aligned with a flat portion of a D-shaped opening in said D-block;

lowering said post into said D-shaped opening until a top inside surface within said locking notch engages a top surface of said D-block, to thereby lock said post in an upright position;

retracting said post by lifting said post to align said turning groove with said D-shaped opening in said D-block;

rotating said post until a longitudinal flat surface on said post is aligned with said flat portion of said D-shaped opening; and lowering said post into said housing to a lowered stored position.

* * * * *